US010588465B2

(12) United States Patent
Granger

(10) Patent No.: US 10,588,465 B2
(45) Date of Patent: Mar. 17, 2020

(54) SHOWER CURTAIN SYSTEM AND METHOD OF USE

(71) Applicant: Robert L. Granger, Conroe, TX (US)

(72) Inventor: Robert L. Granger, Conroe, TX (US)

( * ) Notice: Subject to any disclaimer, the term of this patent is extended or adjusted under 35 U.S.C. 154(b) by 0 days.

(21) Appl. No.: 16/103,345

(22) Filed: Aug. 14, 2018

(65) Prior Publication Data

US 2019/0045982 A1 Feb. 14, 2019

Related U.S. Application Data

(60) Provisional application No. 62/545,004, filed on Aug. 14, 2017.

(51) Int. Cl.

| | |
|---|---|
| ***A47K 3/38*** | (2006.01) |
| ***A47H 1/02*** | (2006.01) |
| ***A47K 3/28*** | (2006.01) |
| ***A47H 1/102*** | (2006.01) |

(52) U.S. Cl.

CPC ..... *A47K 3/38* (2013.01); *A47H 1/02* (2013.01); *A47H 1/102* (2013.01); *A47K 3/281* (2013.01); *A47H 2001/0205* (2013.01)

(58) Field of Classification Search

CPC . A47K 3/38; A47K 3/281; A47H 1/02; A47H 1/102; A47H 2001/0205

See application file for complete search history.

(56) References Cited

U.S. PATENT DOCUMENTS

| | | | | |
|---|---|---|---|---|
| 1,746,269 | A * | 2/1930 | Lupton | A47H 21/00 160/128 |
| 5,103,531 | A * | 4/1992 | Perrotta | A47K 3/38 16/87 R |
| 8,201,286 | B1 * | 6/2012 | Parker | A47K 3/38 4/609 |
| 9,044,115 | B1 * | 6/2015 | Chirigotis | A47K 3/38 |
| 2008/0184479 | A1 * | 8/2008 | Bathurst | A47K 3/38 4/610 |
| 2011/0198045 | A1 * | 8/2011 | Wieland | A47K 3/38 160/368.1 |

* cited by examiner

*Primary Examiner* — Janie M Loeppke

(74) *Attorney, Agent, or Firm* — Richard Eldredge

(57) ABSTRACT

A shower curtain displacement apparatus for use in a bathtub includes a curved rod having a first end and a second end; a first attachment device positioned at the first end of the curved rod and attached to the first end via a first pivot joint; a second attachment device positioned at the second end of the curved rod and attached to the first end via a second pivot joint; the curved rod is to extend a length of the bathtub and secure to sidewalls of the bathtub via the first and second attachment devices; the curved rod is to pivot relative to the sidewalls of the bathtub into a first position and a second position; and the first position is to displace a shower curtain away from the bathtub and the second position is to allow the shower curtain to retract closer to the bathtub.

1 Claim, 6 Drawing Sheets

SHOWER CURTAIN SYSTEM AND METHOD OF USE

BACKGROUND

1. Field of the Invention

The present invention relates generally to shower curtain systems, and more specifically, to a shower curtain system for maximizing space within a shower and a bathroom.

2. Description of Related Art

Shower curtain systems are well known in the art and are effective means to hold a shower curtain in place within a shower/bathtub frame. For example, FIG. 1 depicts a conventional shower curtain system 101 having a bathtub 103 with a shower curtain 105 held up by a shower curtain rod 107.

One of the problems commonly associated with system 101 is limited space. For example, many people enjoy larger showering areas and shower curtain 105 may require placement wherein the bathtub space is limited. In addition, in shower curtain systems wherein the shower curtain rod is curved, thereby maximizing the bathtub space, the shower curtain may be pushed into the bathroom area, thereby reducing the space of the bathroom.

Accordingly, although great strides have been made in the area of shower curtain systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

and

Figure 1:
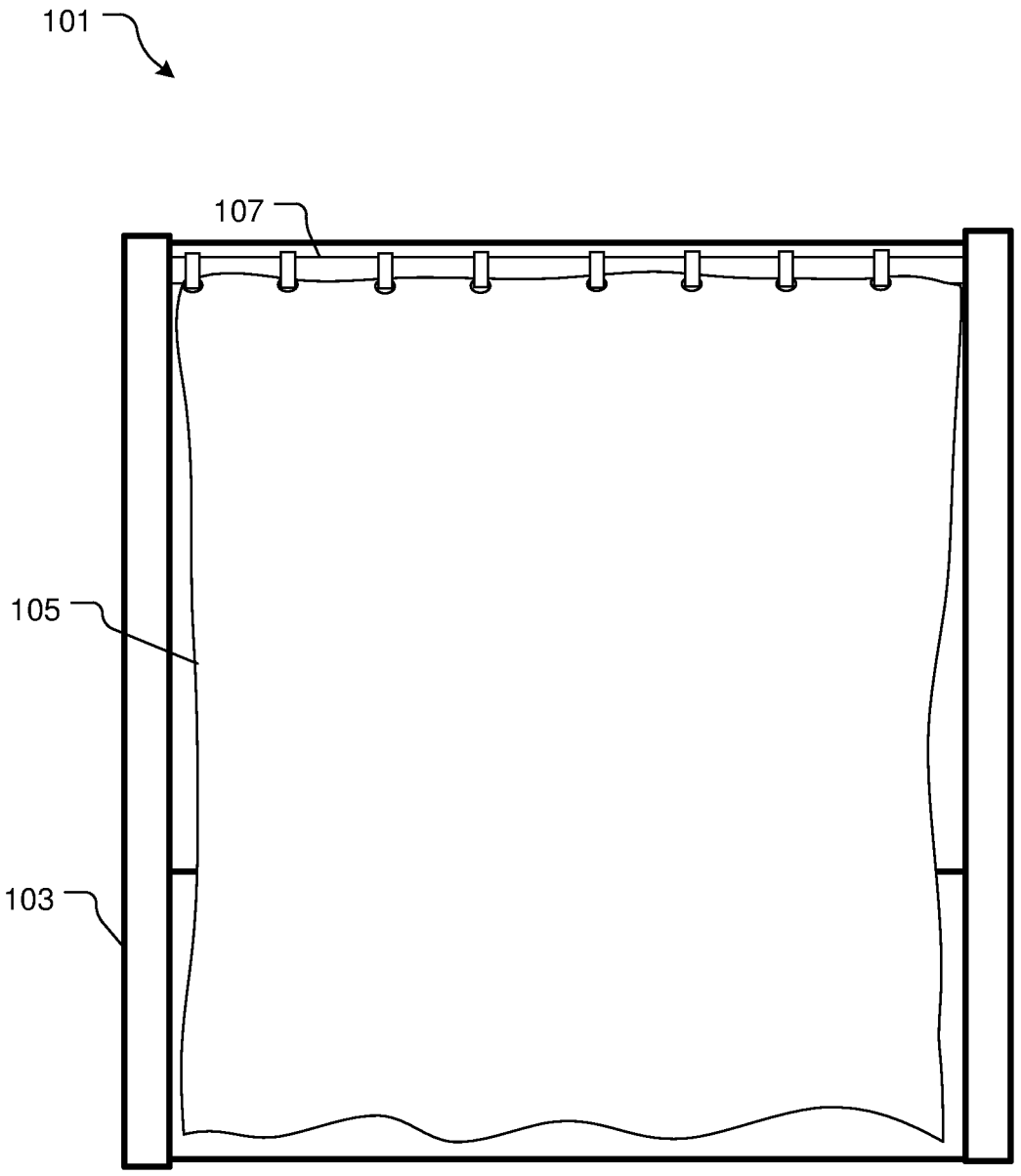
FIG. 1 (Prior Art)
FIG. 1 is a front view of a common shower curtain system.
Figure 2:
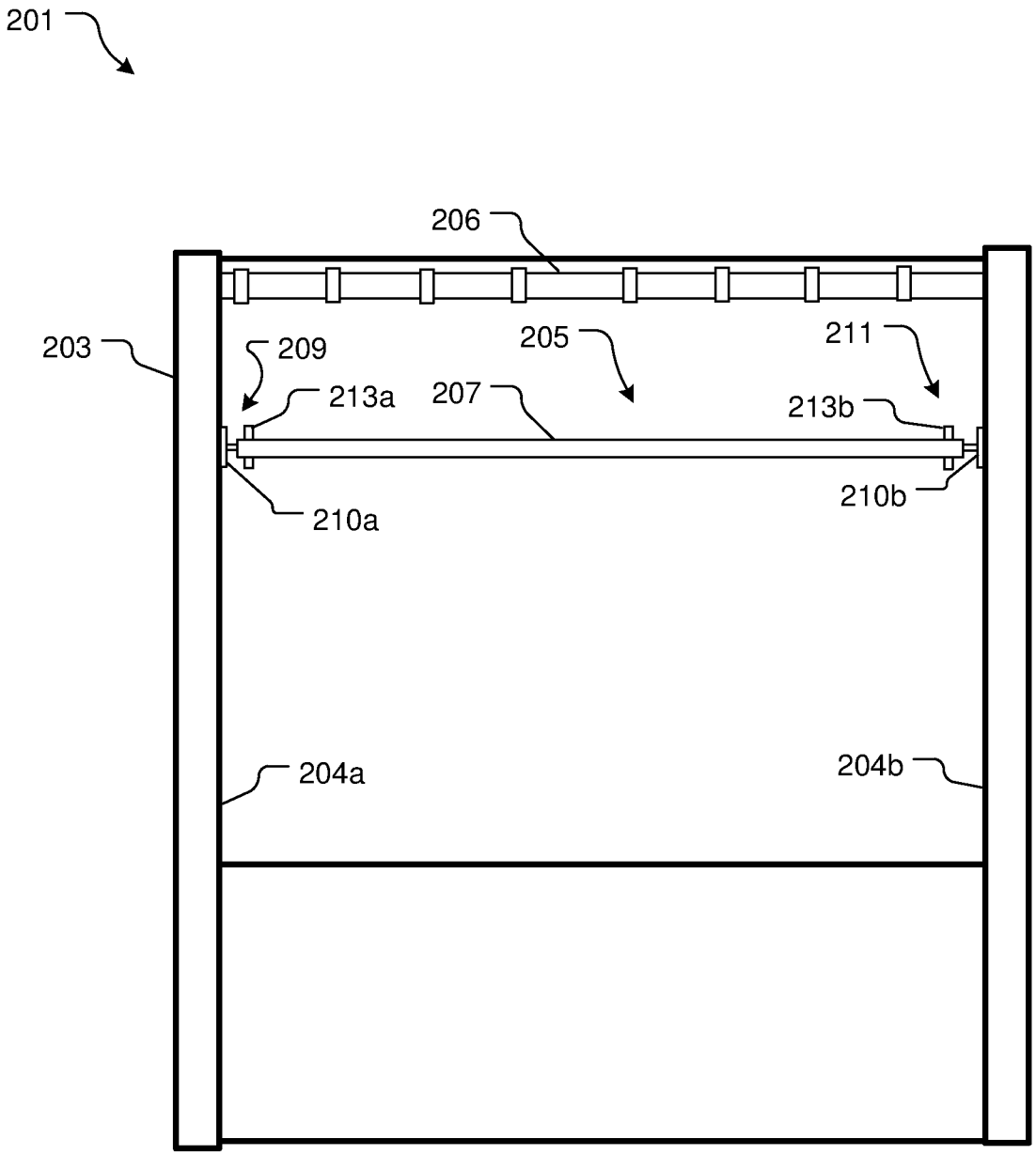
FIG. 2 is a front view of a shower curtain system in accordance with a preferred embodiment of the present application in a first position.
Figure 6:
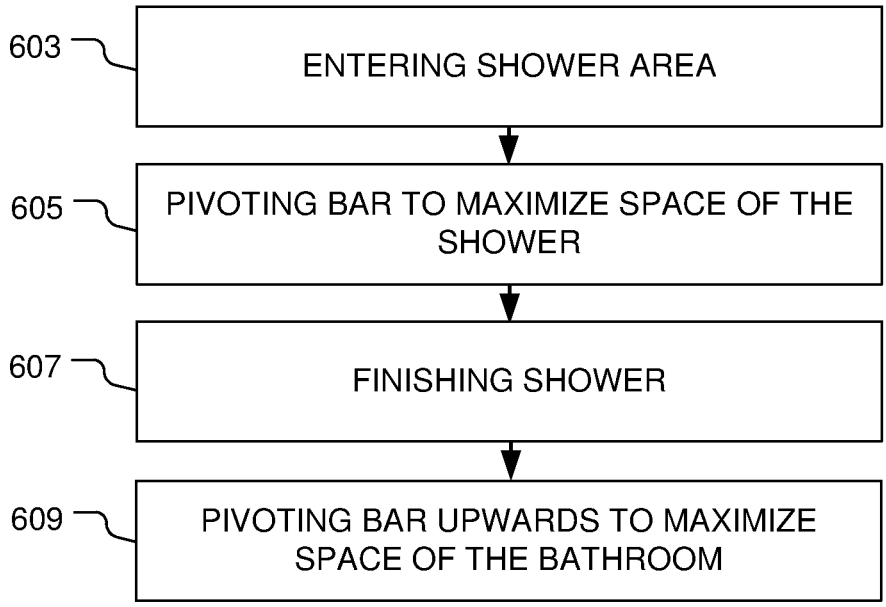

FIG. 6 is a flowchart of the method of use of the system of FIG. 2.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional shower curtain systems. Specifically, the present invention provides a means to widen the area associated with the bathtub. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 2 depicts a front view of a shower curtain system 201 in accordance with a preferred embodiment of the present application. It will be appreciated that system 201 overcomes one or more of the above-listed problems commonly associated with conventional shower curtain systems.

Figure 3:
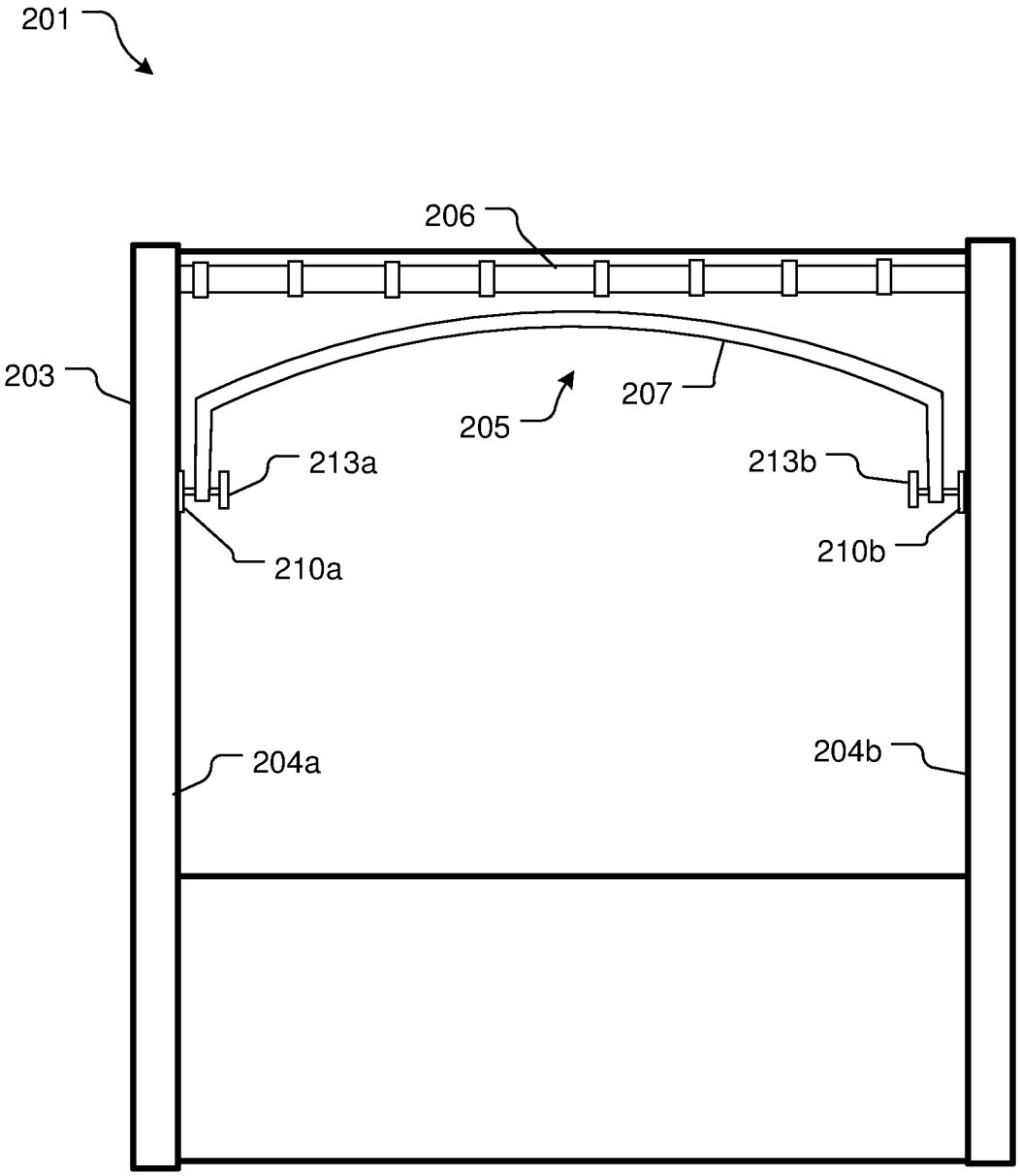
FIG. 3 is a front view of the shower curtain system of FIG. 2 in in a second position.

In the contemplated embodiment, system 201 includes a bathtub 203 having side walls 204*a-b* configured to secure a shower curtain therebetween via a shower curtain rod 206. It should be appreciated that bathtub 203 can be various sizes and shapes. In FIGS. 2 and 3, the shower curtain associated with system 201 is removed for clarity.

System 201 further includes a shower curtain displacement apparatus 205 having a bar 207 extending from a first end 209 to a second end 211. It should be appreciated that bar 207 is curved, as shown in FIG. 3, and connected to sidewalls 204*a-b* via attachment devices 210*a-b*. It should be appreciated that bar 207 can include an adjustment means, thereby making the bar appropriate for use with variously sized bathtubs. It is contemplated that attachment devices 210*a-b* can connect to sidewalls 204*a-b* via pressure, suction, permanent mounting, or any other means. It should be appreciated that the bar could be curved based on pressure created between the sidewalls, or alternatively can be formed as a curve. Further, it should be appreciated that the bar can be rigid or flexible, as aesthetical, manufacturing, or functional considerations require. It should further be appreciated that the curve of bar 207 can be centered or off center and vary in depth.

In the contemplated embodiment, bar 207 is connected to attachment devices 209*a-b* via pivot joints 213*a-b*, thereby allowing for bar 207 to pivot relative to the sidewalls. It is contemplated that pivot joints 213*a-b* and attachment devices 209*a-b* can be combined into one device, such as a pivot bracket as is common in the art. Pivot joints 213*a-b* can further include locking means, thereby providing a means to lock bar 207 in a first and second position (FIGS. 2 and 3 respectively).

Figure 4:
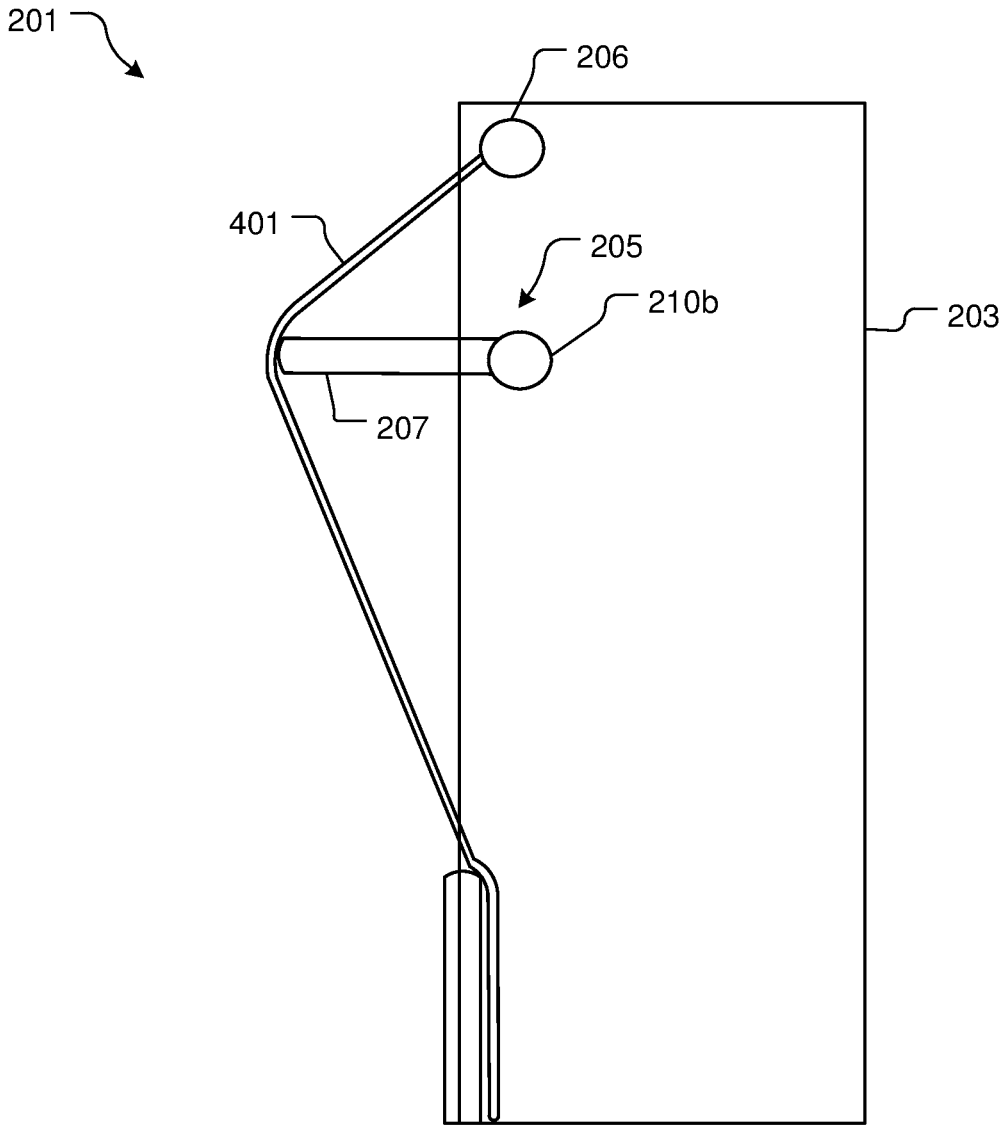
FIG. 4 is a side view of the shower curtain system of FIG. 2 in the first position.
Figure 5:
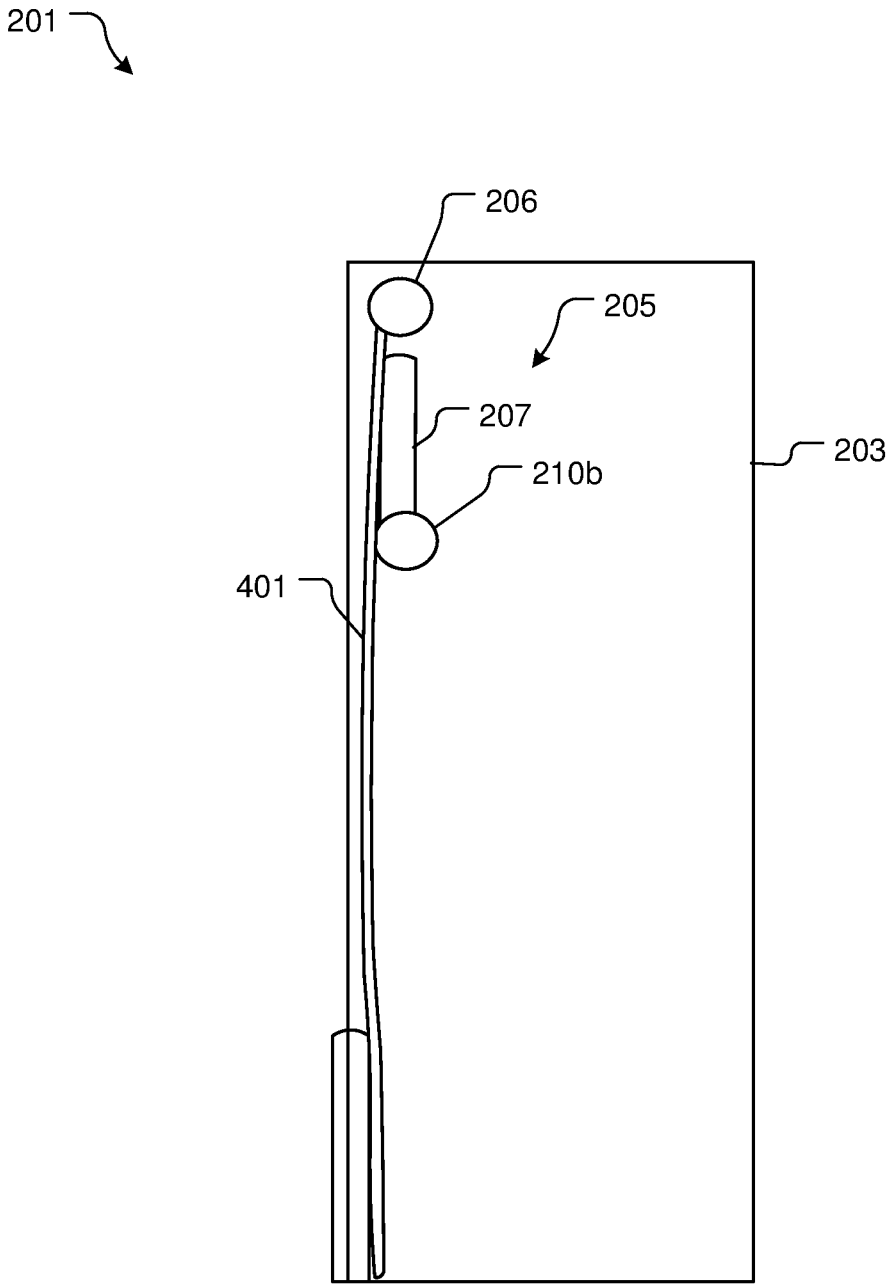
FIG. 5 is a side view of the shower curtain system of FIG. 2 in the second position.

Simplified side views of system 201 are shown in FIGS. 4 and 5 further demonstrate the positioning of bar 207 and the displacement of shower curtain 401. As shown in FIG. 4, in a first position, the curve of bar 207 is configured to allow the bar to extend away from bathtub 203, thereby pushing shower curtain 401 away from a user in the shower. This configuration allows the user to maximize space while showering. In FIG. 5, in a second position, the pivoting of apparatus 205 allows the bar to retract toward bathtub 203, thereby allowing curtain 401 to fall within bathtub 203. In this position, system 201 allows for maximum space associated with the bathroom.

It should be appreciated that one of the unique features believed characteristic of the present application is the configuration of apparatus 205 having a curved bar and being pivotally connected to the sidewalls of bathtub 203. It should be appreciated that this configuration solves the problems commonly associated with conventional shower curtain systems, namely allowing a user to maximize space while showering by displacing the shower curtain, while also being able to maximize space associated with the bathroom when not showering.

In FIG. 6, a flowchart 601 depicts a method associated with system 201. During use, the user proceeds to enter the showering area and pivots the bar away from the shower area to maximize space while showering, as shown with boxes 603, 605. The user then completes showering and exits, as shown with box 607. The bar can then be pivoted upwards to allow the shower curtain to retract toward the bathtub, thereby maximizing space associated with the bathroom, as shown with box 609.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A shower curtain displacement system for use in a bathtub having a first sidewall and a second sidewall with a length extending between the first sidewall and the second sidewall, comprising:

a shower curtain rod secured at a top location of the bathtub and configured to hold a shower curtain, the shower curtain rod engaged with the first sidewall and the second sidewall, the shower curtain rod being stationary;

a shower curtain displacement apparatus being an independent entity from the shower curtain rod and engaging with the first sidewall and the second sidewall independently from the shower curtain rod, the shower curtain displacement apparatus having:

a curved rod having a first end and a second end, the curve rod extending the length between the first sidewall to the second sidewall;

a first attachment device secured to the first sidewall and pivotally attached to the first end of the curved rod, the first attachment device having a first pivot joint configured to pivot the first end of the curved rod from a first position to a second position;

wherein the first position orients and locks the curved rod in a direction parallel to an elongated length of the first sidewall and the second sidewall, and the second position orients and locks the curved rod in a direction perpendicular to the elongated length of the first sidewall and the second sidewall;

a second attachment device secured to second sidewall and pivotally attached to the second end of the curved rod, the second attachment device having a second pivot joint configured to pivot the second end of the curved rod from the first position and the second position;

wherein the first position is configured to displace a shower curtain away from the bathtub and the second position is configured to allow the shower curtain to retract closer to the bathtub.

* * * * *